US011322103B2

(12) United States Patent
Kang

(10) Patent No.: US 11,322,103 B2
(45) Date of Patent: May 3, 2022

(54) DRIVING METHOD AND DRIVING DEVICE OF DISPLAY PANEL AND DISPLAY DEVICE

(71) Applicant: HKC CORPORATION LIMITED, Guangdong (CN)

(72) Inventor: Chihtsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/261,502

(22) PCT Filed: Dec. 18, 2018

(86) PCT No.: PCT/CN2018/121785
§ 371 (c)(1),
(2) Date: Jan. 19, 2021

(87) PCT Pub. No.: WO2020/093528
PCT Pub. Date: May 14, 2020

(65) Prior Publication Data

US 2021/0295789 A1 Sep. 23, 2021

(30) Foreign Application Priority Data

Nov. 5, 2018 (CN) ..... 201811308854.0

(51) Int. Cl.
*G09G 3/36* (2006.01)

(52) U.S. Cl.
CPC ... *G09G 3/3607* (2013.01); *G09G 2320/0242* (2013.01); *G09G 2354/00* (2013.01); *G09G 2360/16* (2013.01)

(58) Field of Classification Search
CPC ..... G09G 2320/06–106
See application file for complete search history.

(56) References Cited

U.S. PATENT DOCUMENTS

2011/0157248 A1* 6/2011 Kang ..... G09G 3/3426 345/690
2014/0225942 A1 8/2014 Liu
2017/0116902 A1* 4/2017 Kuo ..... G09G 3/2003

FOREIGN PATENT DOCUMENTS

CN 101493614 A 7/2009
CN 101572058 A 11/2009
(Continued)

OTHER PUBLICATIONS

PCT International Search Report; Application No. PCT/CN2018/121785; dated Jul. 26, 2019; 6 pages.
(Continued)

*Primary Examiner* — Roy P Rabindranath
(74) *Attorney, Agent, or Firm* — Conley Rose, P.C.; Grant Rodolph

(57) ABSTRACT

The present application relates to the field of display technology, and provides a driving method and a driving device of display panel, and a display device, by calculating an average gray-scale value of original pixel units in each sub-region of the display panel, then judging whether the average gray-scale value is greater than a preset gray-scale threshold. If the average gray-scale value is greater than the preset gray-scale threshold, a corrected pixel voltage value of the sub-region, according to the average gray-scale value and a preset pixel voltage conversion relationship, is determined, and the corrected pixel voltage value as a pixel voltage value of original pixel units in the sub-region is set.

20 Claims, 6 Drawing Sheets

(56) References Cited

FOREIGN PATENT DOCUMENTS

| | | | |
|---|---|---|---|
| CN | 101933078 | A | 12/2010 |
| CN | 104167187 | A | 11/2014 |
| CN | 106251807 | A | 12/2016 |
| CN | 106683627 | A | 5/2017 |
| CN | 106910487 | A | 6/2017 |
| CN | 107424572 | A | 12/2017 |
| KR | 20050061797 | A | 6/2005 |

OTHER PUBLICATIONS

PCT Written Opinion of the International Searching Authority; Application No. PCT/CN2018/121785; dated Jul. 26, 2019; 3 pages.

* cited by examiner

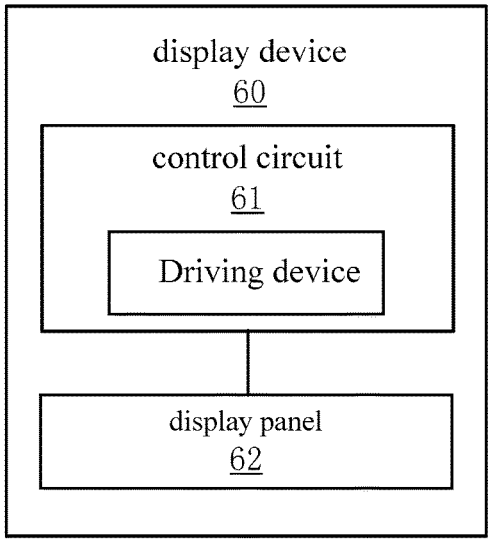

FIG. 9

| Ave_Gn in each block n | Number of Ave_Gn±X in each block n (preferred recommendation X=10) ≥Y% (preferred recommendation Y=60%) | The pixel voltage value VG'255 that maintains the positive view angle gamma voltage in each block n (the Z preferred recommendation is 0.1V) |
|---|---|---|
| 185≤Ave_Gn≤195 | 180≤ Ave_Gn±10≤200 | VG255-Z |
| 195≤Ave_Gn≤205 | 190≤ Ave_Gn±10≤210 | VG255-2Z |
| 205≤Ave_Gn≤215 | 200≤ Ave_Gn±10≤220 | VG255-3Z |
| 215≤Ave_Gn≤225 | 210≤ Ave_Gn±10≤230 | VG255-4Z |
| 225≤Ave_Gn≤235 | 220≤ Ave_Gn±10≤240 | VG255-5Z |
| 235≤Ave_Gn≤245 | 230≤ Ave_Gn±10≤250 | VG255-6Z |
| 245≤Ave_Gn≤255 | 240≤ Ave_Gn±10≤260 | VG255-7Z |

FIG. 10

| Ave_Rn in each block n | Number of Ave_Rn±X in each block n (preferred recommendation X=10) ≥Y% (preferred recommendation Y=60%) | The pixel voltage value VR'255 that maintains the positive view angle gamma voltage in each block n (the Z preferred recommendation is 0.1V) |
|---|---|---|
| 185≤Ave_Rn≤195 | 180≤ Ave_Rn±10≤200 | VR255-Z |
| 195≤Ave_Rn≤205 | 190≤ Ave_Rn±10≤210 | VR255-2Z |
| 205≤Ave_Rn≤215 | 200≤ Ave_Rn±10≤220 | VR255-3Z |
| 215≤Ave_Rn≤225 | 210≤ Ave_Rn±10≤230 | VR255-4Z |
| 225≤Ave_Rn≤235 | 220≤ Ave_Rn±10≤240 | VR255-5Z |
| 235≤Ave_Rn≤245 | 230≤ Ave_Rn±10≤250 | VR255-6Z |
| 245≤Ave_Rn≤255 | 240≤ Ave_Rn±10≤260 | VR255-7Z |

FIG. 11

| Ave_Bn in each block n | Number of Ave_Bn±X in each block n (preferred recommendation X=10) ≥Y% (preferred recommendation Y=60%) | The pixel voltage value VB'255 that maintains the positive view angle gamma voltage in each block n (the Z preferred recommendation is 0.1V) |
|---|---|---|
| 185≤Ave_Bn≤195 | 180≤ Ave_Bn±10≤200 | VB255-Z |
| 195≤Ave_Bn≤205 | 190≤ Ave_Bn±10≤210 | VB255-2Z |
| 205≤Ave_Bn≤215 | 200≤ Ave_Bn±10≤220 | VB255-3Z |
| 215≤Ave_Bn≤225 | 210≤ Ave_Bn±10≤230 | VB255-4Z |
| 225≤Ave_Bn≤235 | 220≤ Ave_Bn±10≤240 | VB255-5Z |
| 235≤Ave_Bn≤245 | 230≤ Ave_Bn±10≤250 | VB255-6Z |
| 245≤Ave_Bn≤255 | 240≤ Ave_Bn±10≤260 | VB255-7Z |

FIG. 12

DRIVING METHOD AND DRIVING DEVICE OF DISPLAY PANEL AND DISPLAY DEVICE

CROSS-REFERENCE TO RELATED APPLICATIONS

The present application is a U.S. National Stage of International Patent Application No. PCT/CN2018/121785, filed on Dec. 18, 2018, which claims priority to Chinese Patent Application No. 201811308854.0 filed on Nov. 5, 2018, both of which are incorporated herein by reference as if reproduced in their entirety.

TECHNICAL FIELD

The present application relates to the field of display technology, and more particularly to a driving method and a driving device of display panel, and a display device.

BACKGROUND

Large-size liquid crystal display panels usually use vertical alignment (VA) type liquid crystal panels or in-plane switching (IPS) type liquid crystal panels. VA type liquid crystal panel technology has the advantage of higher production efficiency and lower manufacturing cost than IPS type liquid crystal panel technology.

However, the VA type liquid crystal panel technology will quickly saturate when the brightness of the large view angle increases with the increase of the driving voltage, which causes the image quality of the display panel to be distorted when the view angle is large, which reduces the user experience.

SUMMARY

An object of the present application is to provide a driving method of display panel, including but not limited to eliminating the image quality distortion of the display panel due to quick saturation when the brightness of the large view angle increases with the increase of the driving voltage, and improving user experience. An object of the present application is to provide a driving method of display panel, which includes: calculating an average gray-scale value of original pixel units in each sub-region of the display panel, judging whether the average gray-scale value is greater than a preset gray-scale threshold, wherein, if the average gray-scale value is greater than the preset gray-scale threshold, determining a corrected pixel voltage value of the sub-region according to the average gray-scale value and a preset pixel voltage conversion relationship, and setting the corrected pixel voltage value as a pixel voltage value of original pixel units in the sub-region.

Another object of the present application is to provide a driving device of display panel, which includes an average gray-scale calculation circuit, configured for calculating an average gray-scale value of original pixel units in each sub-region of the display panel, wherein, the display panel is divided into n sub-regions, and n is an integer greater than 1, an average gray-scale judgment circuit, configured for judging whether the average gray-scale value is greater than a preset gray-scale threshold, a pixel voltage acquisition circuit, configured for determining a corrected pixel voltage value of the sub-region according to the average gray-scale value and a preset pixel voltage conversion relationship when the average gray-scale value is greater than the preset gray-scale threshold, and a pixel voltage arrangement circuit, configured for setting the corrected pixel voltage value as a pixel voltage value of original pixel units in the sub-region.

A further object of the present application is to provide a display device, which includes a display panel, and a control circuit, electrically connected with the display panel, wherein the control circuit is configured for executing a driving method of the display panel. The driving method includes calculating an average gray-scale value of original pixel units in each sub-region of the display panel, judging whether the average gray-scale value is greater than a preset gray-scale threshold, wherein, if the average gray-scale value is greater than the preset gray-scale threshold, determining a corrected pixel voltage value of the sub-region according to the average gray-scale value and a preset pixel voltage conversion relationship, and setting the corrected pixel voltage value as a pixel voltage value of original pixel units in the sub-region.

In the driving method and the driving device of display panel, and the display device provided by embodiments of the present application, by calculating the average gray-scale value of the original pixel units in each sub-region of the display panel, among then, the display panel is divided into n sub-regions, and n is an integer greater than 1, then judging whether the average gray-scale value is greater than a preset gray-scale threshold, if the average gray-scale value is greater than the preset gray-scale threshold, determining a corrected pixel voltage value of the sub-region according to the average gray-scale value and a preset pixel voltage conversion relationship, and setting the corrected pixel voltage value as a pixel voltage value of original pixel units in the sub-region. Thereby, the pixel voltage in the display panel is adjusted to reduce the color shift of the display panel, and the object of eliminating the image quality distortion of the display panel due to quick saturation when the brightness of the large view angle increases with the increase of the driving voltage, and improved user experience is achieved.

BRIEF DESCRIPTION OF THE DRAWINGS

In order to explain the embodiments of the present application more clearly, a brief introduction regarding the accompanying drawings that need to be used for describing the embodiments of the present application or the prior art is given below. It is obvious that the accompanying drawings described as follows are only some embodiments of the present application, for those skilled in the art, other drawings can also be obtained according to the current drawings on the premise of paying no creative labor.

FIG. 9 is a structural schematic diagram of a display device provided by an embodiment of the present application;

FIG. 10 is a relationship table of an average gray-scale value, a corresponding threshold interval and a corresponding pixel voltage of a green pixel unit in a sub-region provided by an embodiment of the present application;

FIG. 11 is a relationship table of an average gray-scale value, a corresponding threshold interval and a corresponding pixel voltage of a red pixel unit in a sub-region provided by an embodiment of the present application; and FIG. 12 is a relationship table of an average gray-scale value, a corresponding threshold interval and a corresponding pixel voltage of a blue pixel unit in a sub-region provided by an embodiment of the present application.

DETAILED DESCRIPTION

Figure 1:
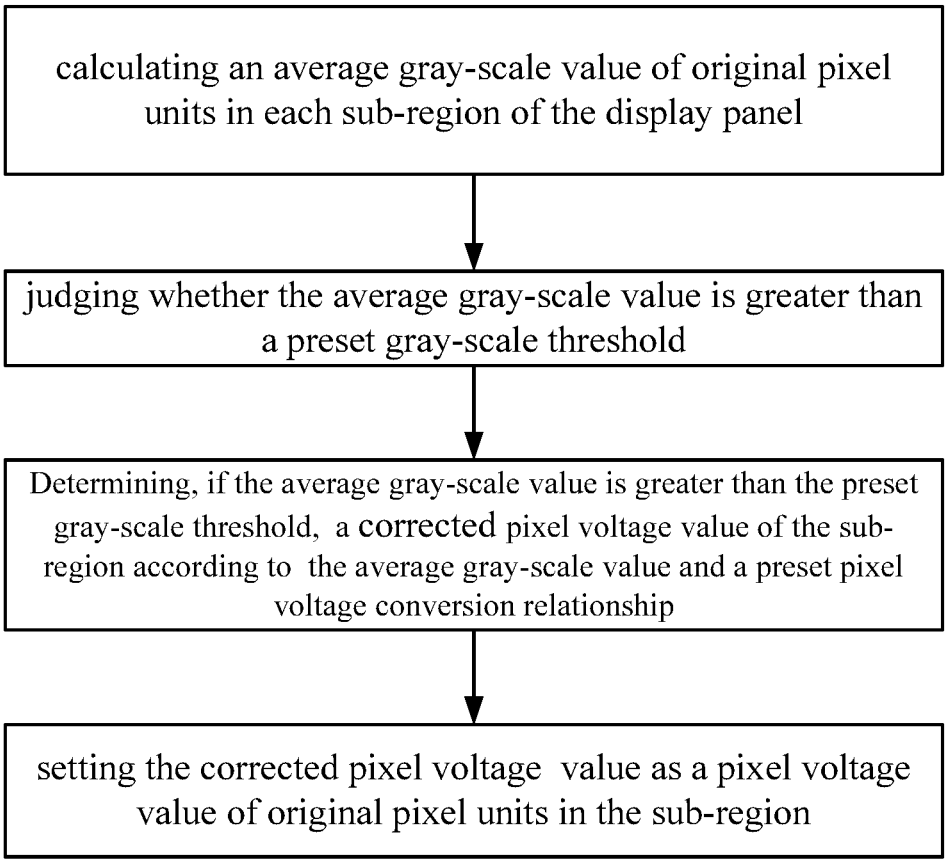
FIG. 1 is a schematic diagram of an implementation flow of a driving method of a display panel provided by an embodiment of the present application.

In order to make the purpose, the technical solution, and the advantages of the present application be clearer and more understandable, the present application will be further described in detail below with reference to accompanying figures and embodiments. It should be understood that the specific embodiments described herein are merely intended to illustrate and not to limit the present application.

It is noted that when a component is referred to as being "fixed to" or "disposed on" another component, it can be directly or indirectly on another component. When a component is referred to as being "connected to" another component, it can be directly or indirectly connected to another component. In the description of the present application, it needs to be understood that, directions or location relationships indicated by terms such as "up", "down", "left", "right" and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application. In addition, terms "the first" and "the second" are only used for descriptive purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

In order to illustrate the technical solutions described in the present application, detailed descriptions are given below in conjunction with specific drawings and embodiments.

In the process of driving the Vertical Alignment (VA) display panels, the brightness of the display panel at a large view angle will quickly saturate as the driving voltage increases, which causes the image quality of the large view angle to deteriorate seriously when compared with the image quality of a positive view angle. In order to solve the problem of visual color shift, the red sub-pixels, green sub-pixels, and blue sub-pixels of the display panel can be divided into primary sub-pixels and secondary sub-pixels, so that the overall brightness of the display panel at the large view angle is closer to the image quality of the positive view angle with the voltage changing, and the primary sub-pixel and the secondary sub-pixel are given different driving voltages spatially to solve the defect of visual color shift. This type of pixel design that divides the primary and secondary sub-pixels often requires redesigning metal traces or adding thin film transistors to drive the sub-pixels, which may sacrifice the transparent opening area, affect the light transmittance of the panel, and increase the backlight cost of the panel.

Each pixel in the display panel is composed of three sub-pixels: a red sub-pixel, a green sub-pixel, and a blue sub-pixel (R, G, B). For each sub-pixel, the light source behind it can show different brightness levels. Specifically, the brightness level is determined by the pixel voltage. The gray-scale represents the levels of different brightness from the darkest to the brightest. The more levels, the more delicate the image effect can be presented. The red, green, and blue of different brightness levels are combined to form dots of different colors. It can be seen that the color change of each dot on the liquid crystal display (LCD) screen is actually brought about by the gray-scale changes of the three original sub-pixels that constitute this dot, and the pixel voltage is used to control the gray-scale of each sub-pixel, thereby the purpose of controlling the display of the image displayed on the display panel can be achieved. Therefore, by adjusting the pixel voltages of all sub-pixels in the display panel, the image quality of the image displayed on the display panel can be adjusted.

FIG. 1 is a schematic diagram of the implementation flow of a driving method of a display panel according to an embodiment of the present application. As shown in FIG. 1, the driving method includes calculating an average gray-scale value of original pixel units in each sub-region of the display panel, among then, the display panel is divided into n sub-regions, and n is an integer greater than 1.

In this embodiment, the display panel in the display device is divided into n sub-regions according to the effect that the panel needs to display. The n sub-regions can be formed according to the array arrangement, and the area of each sub-region is the same. For example, a display panel with a resolution of 1920×1080 is divided into 135 rows and 240 columns. Each sub-region includes 64-pixel units, and each pixel unit includes red pixel units, green pixel units, and blue pixel units. After the display panel is divided into multiple sub-regions, the average gray-scale value of the original pixel units in each sub-region are calculated. The original pixel units are any one of the red pixel units, the green pixel units, and the blue pixel units.

In an embodiment, judging whether the average gray-scale value is greater than a preset gray-scale threshold, if the average gray-scale value is greater than the preset gray-scale threshold, includes determining a corrected pixel voltage value of the sub-region according to the average gray-scale value and a preset pixel voltage conversion relationship.

Since the phenomenon of large view angle color shift is mainly caused by the pixel signal with high gray-scale value, when the average gray-scale value of the original pixel units of the sub-region is lower than the preset gray-scale threshold, the next step is not performed. That is, a corrected pixel voltage value of the sub-region, according to the average gray-scale value and a preset pixel voltage conversion relationship, is not determined, which saves calculation time and calculation steps. The preset gray-scale threshold is set by the user according to the needs of whether the gray-scale value of the original pixel units is a high gray-scale pixel unit. For example, the preset gray-scale threshold in this embodiment can be set to 180. When the average gray-scale value of the original pixel units in the sub-region is lower than 180, then a decision is made not to determine the corrected pixel voltage value of the sub-region, according to the average gray-scale value and the preset pixel voltage conversion relationship. Specifically, each sub-region includes three original pixel units. The average gray-scale values of the three original pixel units are calculated, and then the average gray-scale values of the three original pixel units are compared with the preset gray-scale threshold, respectively.

In this embodiment, the average gray-scale value of the original pixel units in each sub-region is obtained, and the average gray-scale value of the sub-region is judged. When the average gray-scale value is greater than the preset gray-scale threshold, the next step is to proceed. That is, determine the corrected pixel voltage value of the sub-region according to the average gray-scale value and the preset pixel voltage conversion relationship. Specifically, the preset gray-scale threshold is set according to user needs and used to judge whether the average gray-scale value of the original pixel units of the sub-region is in the high gray-scale interval. If the average gray-scale value of the original pixel units is greater than the preset gray-scale threshold value set by the user, it is judged that the average gray-scale value of the original pixel units in the sub-region is in the high gray-scale interval. If the average gray-scale value of the original pixel units is less than or equal to the preset gray-scale threshold set by the user, it is judged that the average gray-scale value of the original pixel units in the sub-region is not in the high gray-scale interval. The preset pixel voltage conversion relationship is setting pixel voltages corresponding to each of the average gray-scale values, and acquiring the pixel voltage corresponding to the average gray-scale value from the preset pixel voltage conversion relationship, according to the average gray-scale value of the original pixel units in the sub-region, when the average gray-scale value of the original pixel units in the sub-region is determined, and determining the pixel voltage as the corrected pixel voltage value of the sub-region.

In an embodiment, the corrected pixel voltage value is set to the pixel voltage value of the original pixel units in the sub-region. In this embodiment, when the corrected pixel voltage value that matches the average gray-scale value of the corresponding sub-region is acquired, the corrected pixel voltage value is set to the pixel voltage value of the original pixel units in the sub-region, that is, by adjusting the pixel voltage value corresponding to the pixel voltage signal of the original pixel units in the sub-region, such that the full gray-scale signal in the sub-region still maintains the exponential relationship of the original positive view signal to the brightness change with respect to the brightness change.

In this embodiment, after the pixel voltage value of the original pixel units in the corresponding sub-region is modified to the corrected pixel voltage value, the difference of the high gray-scale pixel signal to the brightness change becomes smaller, the linearity is improved, and the color shift that easily occurs at the large view angle is reduced.

In an embodiment, the pixel voltage value of the original pixel units in the sub-region is the pixel voltage value of the total maximum pixel voltage signal in the sub-region.

FIG. 10 is a relationship table of the average gray-scale value, the corresponding threshold interval, and the corresponding pixel voltage value of the green pixel units in the sub-region provided by an embodiment of the present application. The driving chip in the present embodiment is an 8-bit driving chip, the gray-scale value of the driving chip ranges from 0 to 255. As shown in FIG. 10, Ave_Gn in each block n represents the average gray-scale value of the green pixel units in the sub-region labeled n, and the Number of Ave_Gn±X in each block n indicates the ratio of the number within the gray-scale value threshold interval Ave_Gn±X determined according to the average gray-scale value of the green pixel units in the sub-region labeled n to the total number of original pixel units in the sub-region is greater than or equal to Y %, optionally, Y=60%. The positive view angle Green Gamma in each block n maintains G_gamma, and the 255 gray voltage is reduced to VG'255. Specifically, the 255 gray voltage is the pixel voltage value of the maximum pixel voltage signal in the sub-region, and VG'255 is the pixel voltage value corresponding to the average gray-scale value of the green pixel units in the sub-region. Specifically, the number of pixels in the gray-scale value threshold interval Ave_Gn±X of different sub-regions should be greater than Y % of the total number of pixels in the interval. Optionally, Y is 60, and the pixel voltage value of the sub-region is changed. That is, the pixel voltage value of the sub-region is reduced so that the pixel voltage value VG255 of the maximum pixel voltage signal in the sub-region is reduced to VG'255, and the positive view angle signal of the display panel maintains an exponential relationship G_gamma to the brightness change, so that the gamma and other calibration values of the high gray-scale pixel unit at the large view angle are reduced. Optionally, the large view angle brightness corresponding to the signal change is close to the brightness change of gamma <2.4. When the large view angle gamma signal decreases, the continuous signal of most pixel units in the area can reduce the difference in brightness changes.

As shown in FIG. 10, when the driving chip is an 8-bit driving chip and when the average gray-scale value of the green pixel units in the sub-region n is between 185 and 195, a ratio of the number of pixels in the sub-region within the range of plus or minus 10 of the average gray-scale value of the sub-region to the total number of pixels in the interval is calculated. Thus, the average gray-scale of the sub-region is calculated. The number of pixels in the range of plus or minus 10 accounts for the ratio of the total number of pixels in the interval. When the ratio is greater than 60%, the pixel voltage value of the maximum pixel voltage signal of the green pixel units in the sub-region is revised downward from VG255 to VG'255=VG255-Z. Optionally, Z is 0.1V and, specifically, the Z value can be adjusted according to the characteristics of the display panel, Optionally, the Z value can be adjusted according to the non-linear severity of the display panel. That is, the higher the non-linear severity of the display panel the greater the Z value.

FIG. 11 is a relationship table of the average gray-scale value, the corresponding threshold interval, and the corresponding pixel voltage value of the red pixel units in the sub-region provided by an embodiment of the present application. The driving chip in the present embodiment is an 8-bit driving chip, the gray-scale value of the driving chip ranges from 0 to 255. As shown in FIG. 11, Ave_Rn in each block n represents the average gray-scale value of the red pixel units in the sub-region labeled n, and the Number of Ave_Rn±X in each block n indicates the ratio of the number within the gray-scale value threshold interval Ave_Rn±X determined according to the average gray-scale value of the red pixel units in the sub-region labeled n to the total number of original pixel units in the sub-region is greater than or equal to Y %, optionally, Y=60%.

In this embodiment, the positive view angle Red Gamma in each block n maintains R_gamma, and the 255 gray voltage is reduced to VR'255. Specifically, the 255 gray voltage is the pixel voltage value of the maximum pixel voltage signal in the sub-region, and VR'255 is the pixel voltage value corresponding to the average gray-scale value of the red pixel units in the sub-region. When the ratio of the number within the gray-scale value threshold interval Ave_Rn±X determined according to the average gray-scale value of the red pixel units in the sub-region labeled n to the total number of original pixel units in the sub-region is greater than Y %, then adjusting the pixel voltage value of the red pixel units in the sub-region according to the relationship table of the average gray-scale value, the corresponding threshold interval, and the corresponding pixel voltage value of the red pixel units in the sub-region in FIG. 11, the pixel voltage value of the maximum pixel voltage signal of the red pixel units in the sub-region is revised downward from VR255 to VR'255=VR255-Z. Optionally, Z is 0.1V and, specifically, the Z value can be adjusted according to the characteristics of the display panel. Optionally, the Z value can be adjusted according to the non-linear severity of the display panel. That is, the higher the non-linear severity of the display panel, the greater the Z value, and the color shift that is prone to large view angles can be reduced.

FIG. 12 is a relationship table of the average gray-scale value, the corresponding threshold interval, and the corresponding pixel voltage value of the blue pixel units in the sub-region provided by an embodiment of the present application. The driving chip in the present embodiment is an 8-bit driving chip, the gray-scale value of the driving chip ranges from 0 to 255.

As shown in FIG. 12, Ave_Bn in each block n represents the average gray-scale value of the blue pixel units in the sub-region labeled n, and the Number of Ave_Bn±X in each block n indicates the ratio of the number within the gray-scale value threshold interval Ave_Bn±X determined according to the average gray-scale value of the blue pixel units in the sub-region labeled n to the total number of original pixel units in the sub-region is greater than or equal to Y %, optionally, Y=60%.

In this embodiment, the positive view angle Blue Gamma in each block n maintains B_gamma, and the 255 gray voltage is reduced to VB'255. Specifically, the 255 gray voltage is the pixel voltage value of the maximum pixel voltage signal in the sub-region, and VB'255 is the pixel voltage value corresponding to the average gray-scale value of the blue pixel units in the sub-region. When the ratio of the number within the gray-scale value threshold interval Ave_Bn±X determined according to the average gray-scale value of the blue pixel units in the sub-region labeled n to the total number of original pixel units in the sub-region is greater than Y %, then adjusting the pixel voltage value of the blue pixel units in the sub-region, according to the relationship table of the average gray-scale value, the corresponding threshold interval, and the corresponding pixel voltage value of the blue pixel units in the sub-region in FIG. 12, the pixel voltage value of the maximum pixel voltage signal of the blue pixel units in the sub-region is revised downward from VB255 to VB'255=VB255-Z. Optionally, Z is 0.1V.

In an embodiment, the Z value can be adjusted according to the characteristics of the display panel. Optionally, the Z value can be adjusted according to the non-linear severity of the display panel. That is, the higher the non-linear severity of the display panel, the greater the Z value, and the color shift that is prone to large view angles can be reduced.

In an embodiment, the preset pixel voltage conversion relationship may be the relationship tables in FIG. 10, FIG. 11, and FIG. 12 described above.

In an embodiment, the preset pixel voltage conversion relationship may also be set according to user needs. For example, the preset pixel voltage conversion relationship may be the pixel voltage value corresponding to the ratio of the total amount of original pixel units in the preset gray-scale threshold interval to the total amount of all original pixel units in the sub-region, or the pixel voltage value corresponding to the average gray-scale value of the original pixel units in the sub-region. The pixel voltage value and the average gray-scale value of the original pixel units in the sub-region may also be a certain linear or non-linear relationship. For example, the pixel voltage corresponding to the average gray-scale value of the original pixel units and the average gray-scale value of the original pixel units are set according to a preset linear relationship.

Figure 2:
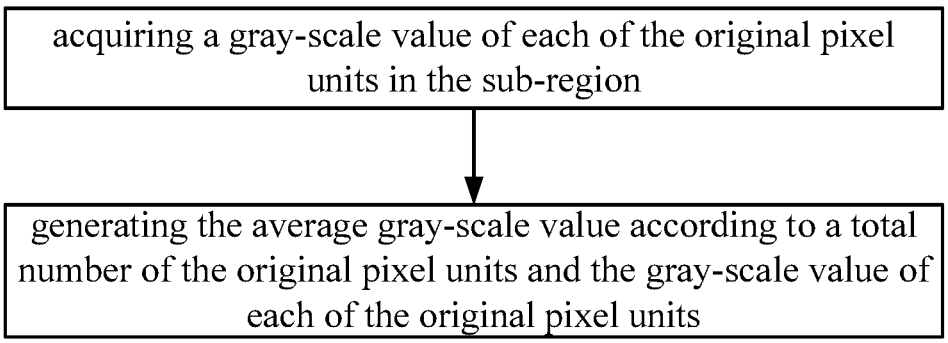
FIG. 2 is a schematic diagram of an implementation flow of another driving method of a display panel provided by an embodiment of the present application.

In an embodiment, FIG. 2 is a schematic diagram of the implementation flow of another driving method of a display panel provided by an embodiment of the present application. As shown in FIG. 2, in this embodiment, the above step of calculating an average gray-scale value of original pixel units in each sub-region of the display panel can include acquiring a gray-scale value of each of the original pixel units in the sub-region; and generating the average gray-scale value according to a total number of the original pixel units and the gray-scale value of each of the original pixel units.

In this embodiment, after the display panel is divided into n sub-regions, the gray-scale value of the original pixel units in each sub-region is detected, where the original pixel units are divided into three types of units: red pixel units, green pixel units, and blue pixel units. That is, the gray-scale value of each original pixel units is detected, the number of each original pixel units in each sub-region is counted, and the average gray-scale value of each original pixel unit in each sub-region is calculated. For example, counting the number of red pixel units in the sub-region and the sum of the gray-scale value of all red pixel units in the sub-region when acquiring the average gray-scale value of the red pixel units in the sub-region, then dividing the sum of the gray-scale value of all red pixel units by the number of red pixel units in the sub-region to get the average gray-level value of the red pixel units in the sub-region. Counting the number of green pixel units in the sub-region and the sum of the gray-scale value of all green pixel units in the sub-region when acquiring the average gray-scale value of the green pixel units in the sub-region, then dividing the sum of the gray-scale value of all green pixel units by the number of green pixel units in the sub-region to get the average gray-level value of the green pixel units in the sub-region.

Figure 3:
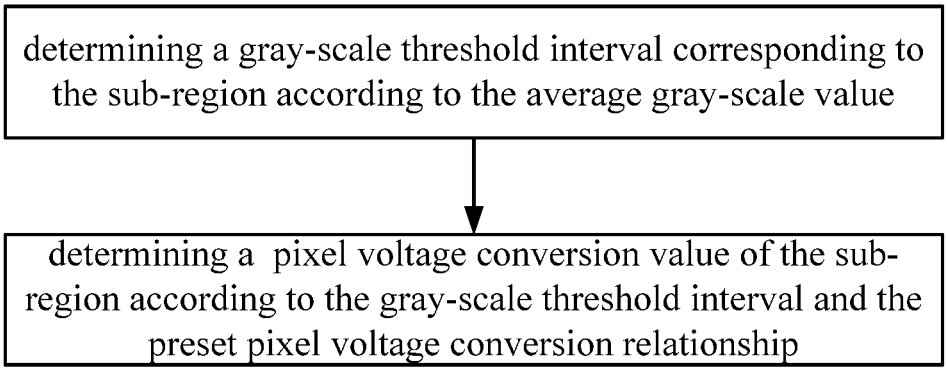
FIG. 3 is a schematic diagram of an implementation flow of another driving method of a display panel provided by an embodiment of the present application.

In an embodiment, FIG. 3 is a schematic diagram of the implementation flow of another driving method of a display panel provided by an embodiment of the present application. As shown in FIG. 3, the step of determining a corrected pixel voltage value of the sub-region, according to the average gray-scale value and a preset pixel voltage conversion relationship includes determining a gray-scale threshold interval corresponding to the sub-region according to the average gray-scale value.

In this embodiment, the average gray-scale value of the original pixel units in each sub-region is acquired, and the average gray-scale value of the original pixel units in the sub-region is judged. When the average gray-scale value is greater than the preset gray-scale threshold, the next step is to proceed, which is to determine the gray-scale threshold interval corresponding to the average gray-scale value of the sub-region according to the average gray-scale value of the sub-region. Specifically, setting the corresponding first gray-scale threshold and the second gray-scale threshold according to the average gray-scale value of each original pixel unit in each sub-region. The first gray-scale threshold is the average gray-scale value plus the first preset gray-scale value, and the second gray-scale threshold is the average gray-scale value minus the second preset gray-scale value. The second gray-scale threshold and the first gray-scale threshold form a gray-scale threshold interval. Specifically, the first preset gray-scale value and the second preset gray-scale value can be set according to user needs to determine the gray-scale threshold interval. For example, the first preset gray-scale value and the second preset gray-scale value are both 10. When the average gray-scale value of the sub-region is acquired, the average gray-scale value is plus 10 to acquire the first gray-scale threshold, and minus 10 to acquire the second gray-scale threshold, thereby acquiring the gray-scale threshold interval in which the average gray-scale value is located.

In an embodiment, the corrected pixel voltage value of the sub-region is determined according to the gray-scale threshold interval and the preset pixel voltage conversion relationship.

In this embodiment, the original pixel units whose average gray-scale value is higher than the preset gray-scale threshold are selected to determine the gray-scale threshold interval. The preset pixel voltage conversion relationship includes the gray-scale threshold interval and after acquiring corrected pixel voltage value corresponding to the gray-scale threshold interval, the gray-scale threshold interval, and then acquiring the corrected pixel voltage value corresponding to the gray-scale threshold interval from the preset pixel voltage conversion relationship according to the gray-scale threshold interval.

Figure 4:
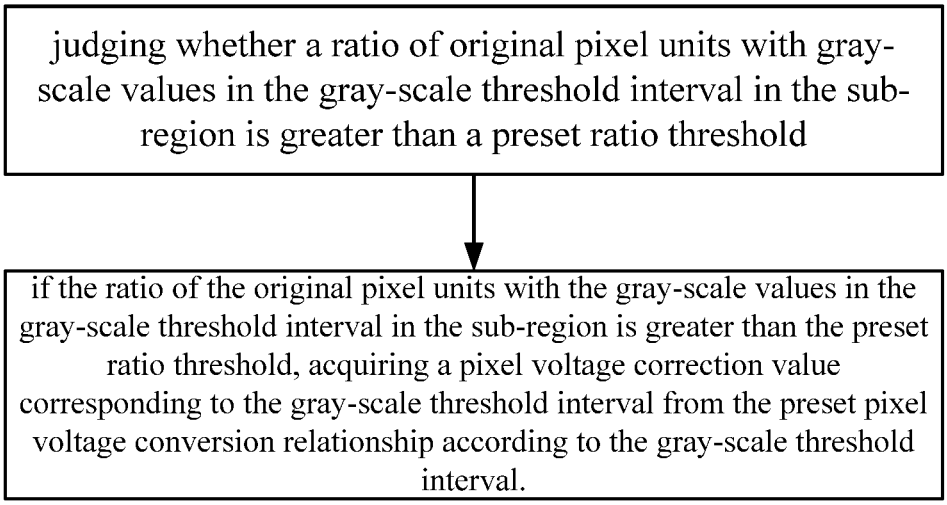
FIG. 4 is a schematic diagram of an implementation flow of another driving method of a display panel provided by an embodiment of the present application.

In an embodiment, the preset pixel voltage conversion relationship includes when the ratio of the total amount of original pixel units in the gray-scale threshold interval to the total amount of all original pixel units in the sub-region is greater than the preset ratio threshold, then the average gray-scale value of the original pixel units of the sub-region has a linear relationship with the preset pixel voltage value. Specifically, the average gray-scale value increases from 180 to 255, and the corresponding pixel voltage value decreases from the original pixel voltage VG255 to VG255-7Z, where Z is 0.1. FIG. 4 is a schematic diagram of an implementation flow of another driving method of a display panel provided by an embodiment of the present application.

As shown in FIG. 4, the step of determining a pixel voltage conversion value of the sub-region according to the gray-scale threshold interval and the preset pixel voltage conversion relationship comprises judging whether the ratio of original pixel units, whose gray-scale value is in the gray-scale threshold interval in the sub-region, is greater than a preset ratio threshold.

In this embodiment, when the ratio of the total amount of original pixel units in the gray-scale threshold interval to the total amount of all original pixel units in the sub-region is greater than the preset ratio threshold, the pixel voltage value of the sub-region is corrected downward so that the brightness changes of most of the original pixel units in the sub-area are relatively linear.

In this embodiment, the gray-scale threshold interval corresponding to the average gray-scale value of the sub-region is acquired, the total number of original pixel units, whose gray-scale values are in the gray-scale threshold interval, is calculated in the sub-region, the ratio of the total amount of original pixel units in the gray-scale threshold interval to the total amount of all original pixel units in the sub-area is calculated, and whether the ratio is greater than the preset ratio threshold is determined. Specifically, the preset ratio threshold is set according to user needs for determining the ratio of the original pixel units whose gray-scale value is in the gray-scale threshold interval in the sub-region. The ratio is used to judge the degree of color shift of the large view angle of the sub-region. If the ratio of the original pixels in the sub-region, whose gray-scale value is in the gray-scale threshold interval is lower than the preset ratio threshold, the next step is to not proceed. That is, to not determine a pixel voltage conversion value of the sub-region according to the gray-scale threshold interval and the preset pixel voltage conversion relationship.

In an embodiment, if the ratio of the original pixel units with the gray-scale values in the gray-scale threshold interval in the sub-region is greater than the preset ratio threshold, then a corrected pixel voltage value corresponding to the gray-scale threshold interval from the preset pixel voltage conversion relationship according to the gray-scale threshold interval is acquired.

In this embodiment, the ratio of original pixel units, whose gray-scale values are in the gray-scale threshold interval in the sub-region, is acquired. That is, the ratio of the total amount of original pixel units in the gray-scale threshold interval to the total amount of all original pixel units in the sub-region, if the ratio is greater than the preset ratio threshold, the corrected pixel voltage value of the sub-region is determined from the preset pixel voltage conversion relationship according to the gray-scale threshold interval.

In an embodiment, the preset ratio threshold is 60%. When the ratio of the total amount of original pixel units in the gray-scale threshold interval to the total amount of all original pixel units in the sub-region is greater than 60%, the pixel voltage value of the original pixel units in the sub-region is adjusted. Specifically, during the adjustment of the pixel voltage value of the original pixel units in the sub-region, by reducing the original pixel voltage value in the sub-region, the large view angle brightness of the display panel is close to the positive view angle brightness. According to the new pixel voltage, the full gray-scale signal to the brightness change still maintains the exponential relationship with the original positive view signal to the brightness change. By reducing the pixel voltage of the original pixel units, the linearity of most pixel signals in the sub-region to the brightness change can be increased, and the color shift that is prone to large view angles can be reduced.

In this embodiment, the preset pixel voltage conversion relationship can be preset according to user needs. For example, the preset pixel voltage conversion relationship may be a relationship table of an average gray-scale value preset by the user, a corresponding threshold interval, and a corresponding pixel voltage value for maintaining the positive view signal.

In an embodiment, the gray-scale threshold interval includes a first gray-scale threshold and a second gray-scale threshold; specifically, the first gray-scale threshold is the average gray-scale value plus a first preset gray-scale value, and the second gray-scale threshold is the average gray-scale value minus a second preset gray-scale value.

In this embodiment, the corresponding first gray-scale threshold and second gray-scale threshold are set according to the average gray-scale value of each original pixel unit in each sub-region. The first gray-scale threshold is the average gray-scale value plus the first preset gray-scale value, and the second gray-scale threshold value is the average gray-scale value minus the second preset gray-scale value. Specifically, the first preset gray-scale value and the second preset gray-scale value can be set according to user needs.

Optionally, the first preset gray-scale value is equal to the second preset gray-scale value.

Figure 5:
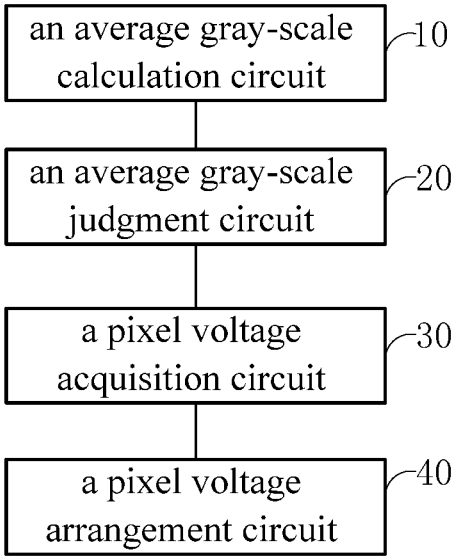
FIG. 5 is a structural schematic diagram of a driving device of a display panel provided by an embodiment of the present application.

In an embodiment, as shown in FIG. 5, the driving device of the present embodiment includes an average gray-scale calculation circuit 10, an average gray-scale judgment circuit 20, a pixel voltage acquisition circuit 30, and a pixel voltage arrangement circuit 40. Specifically, the average gray-scale calculation circuit 10 is configured for calculating an average gray-scale value of original pixel units in each sub-region of the display panel. The display panel is divided into n sub-regions, and n is an integer greater than 1, The average gray-scale judgment circuit 20 is configured for judging whether the average gray-scale value is greater than a preset gray-scale threshold, and the pixel voltage acquisition circuit 30 is configured for determining a corrected pixel voltage value of the sub-region according to the average gray-scale value and a preset pixel voltage conversion relationship, when the average gray-scale value is greater than the preset gray-scale threshold and the pixel voltage arrangement circuit 40 is configured for setting the corrected pixel voltage value as a pixel voltage value of original pixel units in the sub-region.

In this embodiment, according to the display effect of the panel, the average gray-scale calculation circuit 10 calculates the average gray-scale value of the original pixel units in each sub-region of the display panel, the display panel in the display device is divided into n sub-regions according to the effect that the panel needs to display. The n sub-regions can be formed according to the array arrangement, and the area of each sub-region is the same. For example, a display panel with a resolution of 1920×1080 is divided into 135 rows and 240 columns. Each sub-region includes 64-pixel units, and each pixel unit includes red pixel units, green pixel units, and blue pixel units. After the display panel is divided into multiple sub-regions, the average gray-scale value of the original pixel units in each sub-region is calculated. The original pixel units are any one of the red pixel units, the green pixel units, and the blue pixel units. The average gray-scale calculation circuit 10 acquires the average gray-scale value of the original pixel units in each sub-region, and the average gray-scale judgment circuit 20 judges the average gray-scale value of the sub-region. When the average gray-scale value is greater than the preset gray-scale threshold, the pixel voltage acquisition circuit 30 determines the corrected pixel voltage value of the sub-region according to the average gray-scale value and the preset pixel voltage conversion relationship. At this time, the pixel voltage arrangement circuit 40 arranges the corrected pixel voltage value as the pixel voltage value of the original pixel units in the sub-region.

Since the phenomenon of large view angle color shift is mainly caused by the pixel signal with high gray-scale value, in this embodiment, when the average gray-scale value of the original pixel units is less than or equal to the preset gray-scale threshold set by the user, it is judged that the average gray-scale value of the original pixel units in the sub-region is not in the high gray-scale interval, and the pixel voltage value in the sub-region is not adjusted, which saves calculation time and calculation steps. For example, the preset gray-scale threshold in this embodiment can be set to 180. When the average gray-scale value of the original pixel units in the sub-region is lower than 180, the pixel voltage value of the original pixel units in the sub-region is not adjusted. Specifically, each sub-region includes three original pixel units. That is, each original pixel unit has a pixel voltage value corresponding to the original pixel unit, the average gray-scale value is calculated for the three original pixel units in each sub-region, and the average gray-scale values of the three original pixel units are all compared with the preset gray-scale threshold. If the average gray-scale value is greater than the preset gray-scale threshold, then determining the corrected pixel voltage value of the sub-region according to the average gray-scale value and the preset pixel voltage conversion relationship, the preset pixel voltage conversion relationship is setting pixel voltages corresponding to each of the average gray-scale values, and acquiring the pixel voltage corresponding to the average gray-scale value from the preset pixel voltage conversion relationship according to the average gray-scale value of the original pixel units in the sub-region, wherein the average gray-scale value of the original pixel units in the sub-region is determined, and determining the pixel voltage as the corrected pixel voltage value of the sub-region.

Optionally, the corrected pixel voltage value is set to the pixel voltage value of the original pixel units in the sub-region. In this embodiment, when the corrected pixel voltage value that matches the average gray-scale value of the corresponding sub-region is acquired, the corrected pixel voltage value is set to the pixel voltage value of the original pixel units in the sub-region. That is, by adjusting the pixel voltage value corresponding to the pixel voltage signal of the original pixel units in the sub-region, the full gray-scale signal in the sub-region still maintains the exponential relationship of the original positive view signal to the brightness change with respect to the brightness change. In this embodiment, after the pixel voltage value of the original pixel units in the corresponding sub-region is modified to the corrected pixel voltage value, the difference of the high gray-scale pixel signal to the brightness change becomes smaller, the linearity is improved, and the color shift that easily occurs at the large view angle is reduced.

In an embodiment, the pixel voltage value of the original pixel units in the sub-region is the pixel voltage value of the total maximum pixel voltage signal in the sub-region.

In an embodiment, the preset pixel voltage conversion relationship may be the relationship tables shown in FIG. 10, FIG. 11, and FIG. 12 described above.

In an embodiment, the preset pixel voltage conversion relationship may be the pixel voltage value corresponding to the ratio of the total amount of original pixel units in the preset gray-scale threshold interval to the total amount of all original pixel units in the sub-region, or the pixel voltage value corresponding to the average gray-scale value of the original pixel units in the sub-region. The pixel voltage value and the average gray-scale value of the original pixel units in the sub-region may also be a certain linear or non-linear relationship. For example, the pixel voltage corresponding to the average gray-scale value of the original pixel units and the average gray-scale value of the original pixel unit are set according to a preset linear relationship.

Figure 6:
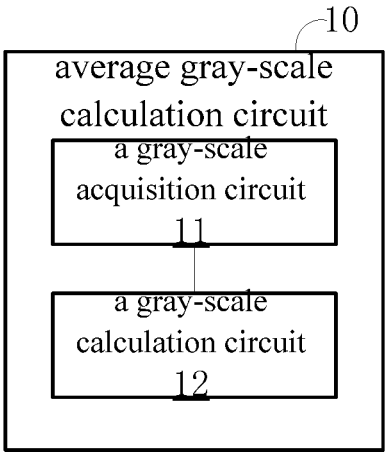
FIG. 6 is a structural schematic diagram of another driving device of a display panel provided by an embodiment of the present application.

In an embodiment, as shown in FIG. 6, the average gray-scale calculation circuit 10 includes a gray-scale acquisition circuit 11 and a gray-scale calculation circuit 12. Specifically, the gray-scale acquisition circuit 11 is configured for acquiring the gray-scale value of each original pixel unit of the sub-region, and the gray-scale calculation circuit 12 is configured for generating the average gray-scale value according to the total number of the original pixel units in the sub-region and the gray-scale value of each original pixel unit.

In this embodiment, after the gray-scale acquisition circuit 11 divides the display panel into n sub-regions, the gray-scale value of the original pixel units in each sub-region is detected, where the original pixel units are divided into three types of units: red pixel units, green pixel units, and blue pixel units. That is, the gray-scale value of each of the original pixel units is detected, and the number of each original pixel units in each sub-region is counted, and the gray-scale calculation circuit 12 calculates the average gray-scale value of each original pixel unit in each sub-region. For example, the gray-scale calculation circuit 12 calculates the number of red pixel units in the sub-region and the sum of the gray-scale of all red pixel units in the sub-region when the gray-scale acquisition circuit 11 acquires the average gray-scale value of the red pixel units in the sub-region, then divides the sum of the gray-scale of all red pixel units by the number of red pixel units in the sub-region to get the average gray-level value of the red pixel units in the sub-region. The gray-scale calculation circuit 12 calculates the number of green pixel units in the sub-region and the sum of the gray-scale of all green pixel units in the sub-region when the gray-scale acquisition circuit 11 acquires the average gray-scale value of the green pixel units in the sub-region, then divides the sum of the gray-scale of all green pixel units by the number of green pixel units in the sub-region to get the average gray-level value of the green pixel units in the sub-region.

Figure 7:
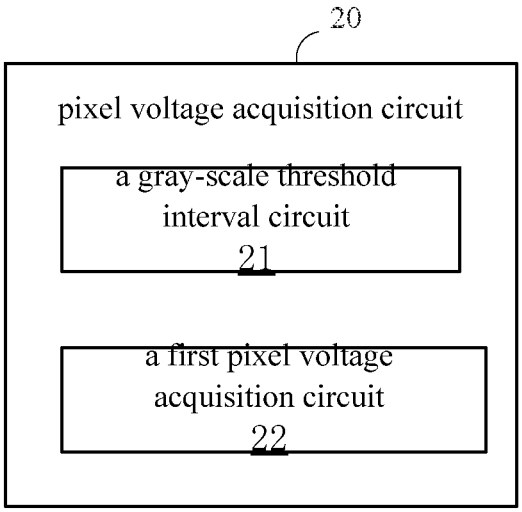
FIG. 7 is a structural schematic diagram of another driving device of a display panel provided by an embodiment of the present application.

In an embodiment, as shown in FIG. 7, the pixel voltage acquisition circuit 20 includes a gray-scale threshold interval circuit 21 and a first pixel voltage acquisition circuit 22.

Specifically, the gray-scale threshold interval circuit 21 is configured for determining a gray-scale threshold interval corresponding to the sub-region according to the average gray-scale value, and the first pixel voltage acquisition circuit 22 is configured for determining the corrected pixel voltage value of the sub-region according to the gray-scale threshold interval and the preset pixel voltage conversion relationship.

In this embodiment, the average gray-scale value of the original pixel units in each sub-region is acquired, and the average gray-scale value of the original pixel units in the sub-region is judged. When the average gray-scale value is greater than the preset gray-scale threshold, the gray-scale threshold interval circuit 21 determines the gray-scale threshold interval corresponding to the average gray-scale value of the sub-region according to the average gray-scale value of the sub-region. Specifically, the corresponding first gray-scale threshold and the second gray-scale threshold are set according to the average gray-scale value of each original pixel unit in each sub-region, the first gray-scale threshold is the average gray-scale value plus the first preset gray-scale value, and the second gray-scale threshold is the average gray-scale value minus the second preset gray-scale value, the second gray-scale threshold and the first gray-scale threshold form a gray-scale threshold interval. Specifically, the first preset gray-scale value and the second preset gray-scale value can be set according to user needs to determine the gray-scale threshold interval, for example, the first preset gray-scale value and the second preset gray-scale value are both 10. When the gray-scale threshold interval circuit 21 acquires the average gray-scale value of the sub-region, the average gray-scale value is plus 10 to acquire the first gray-scale threshold, and minus 10 to acquire the second gray-scale threshold, thereby acquiring the gray-scale threshold interval in which the average gray-scale value is located.

In this embodiment, the gray-scale threshold interval circuit 21 selects the original pixel units whose average gray-scale value is higher than the preset gray-scale threshold to determine the gray-scale threshold interval. The preset pixel voltage conversion relationship includes the gray-scale threshold interval, the corrected pixel voltage value corresponding to the gray-scale threshold interval, and the acquiring the corrected pixel voltage value corresponding to the gray-scale threshold interval from the preset pixel voltage conversion relationship according to the gray-scale threshold interval, after the first pixel voltage acquisition circuit 22 acquires the gray-scale threshold interval.

In an embodiment, the first pixel voltage acquisition circuit 22 is also used to store a preset pixel voltage conversion relationship. Specifically, the preset pixel voltage conversion relationship in this embodiment includes when the ratio of the total amount of original pixel units in the gray-scale threshold interval to the total amount of all original pixel units in the sub-region is greater than the preset ratio threshold, the average gray-scale value of the original pixel units of the sub-region has a linear relationship with the preset pixel voltage value. Specifically, the average gray-scale value increases from 180 to 255, and the corresponding pixel voltage value decreases from the original pixel voltage VG255 to VG255-7Z, where Z is 0.1.

Figure 8:
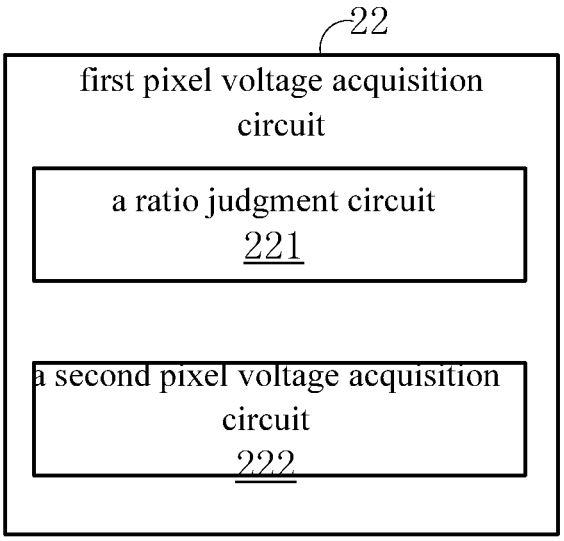
FIG. 8 is a structural schematic diagram of another driving device of a display panel provided by an embodiment of the present application.

In an embodiment, FIG. 8 is a schematic structural diagram of another driving device of a display panel provided by an embodiment of the present application.

As shown in FIG. 8, the first pixel voltage acquisition circuit 22 in this embodiment includes a ratio judgment circuit 221 configured for judging whether the ratio of original pixel units whose gray-scale value is in the gray-scale threshold interval in the sub-region is greater than a preset ratio threshold; and a second pixel voltage acquisition circuit 222 configured for acquiring a corrected pixel voltage value corresponding to the gray-scale threshold interval from the preset pixel voltage conversion relationship according to the gray-scale threshold interval, when the ratio of the original pixel units with the gray-scale values in the gray-scale threshold interval in the sub-region is greater than the preset ratio threshold.

In this embodiment, when the ratio of the total amount of original pixel units in the gray-scale threshold interval to the total amount of all original pixel units in the sub-region is greater than the preset ratio threshold, the pixel voltage value of the sub-region is corrected downward so that the brightness changes of most of the original pixel units in the sub-area are relatively linear.

In this embodiment, the ratio judgment circuit 221 acquires the gray-scale threshold interval corresponding to the average gray-scale value of the sub-region, calculates the total number of original pixel units whose gray-scale values are in the gray-scale threshold interval in the sub-region, calculates the ratio of the total amount of original pixel units in the gray-scale threshold interval to the total amount of all original pixel units in the sub-area, and judges whether the ratio is greater than the preset ratio threshold. Specifically, the ratio judgment circuit 221 is further stored with a preset ratio threshold. The preset ratio threshold is set according to user needs for determining the ratio of the original pixel units whose gray-scale value is in the gray-scale threshold interval in the sub-region. The ratio is used to judge the degree of color shift of the large viewing angle of the sub-region. If the ratio of the original pixels in the sub-region whose gray-scale value is in the gray-scale threshold interval is lower than the preset ratio threshold, the next step is not to proceed. That is, not to determine a pixel voltage conversion value of the sub-region according to the gray-scale threshold interval and the preset pixel voltage conversion relationship.

Optionally, if the ratio of the original pixel units with the gray-scale values in the gray-scale threshold interval in the sub-region is greater than the preset ratio threshold, the second pixel voltage acquisition circuit 222 acquires a corrected pixel voltage value corresponding to the gray-scale threshold interval from the preset pixel voltage conversion relationship according to the gray-scale threshold interval.

In this embodiment, the ratio of original pixel units whose gray-scale values are in the gray-scale threshold interval in the sub-region is acquired. That is, the ratio of the total amount of original pixel units in the gray-scale threshold interval to the total amount of all original pixel units in the sub-region is determined. If the ratio is greater than the preset ratio threshold, the second pixel voltage acquisition circuit 222 determines the corrected pixel voltage value of the sub-region from the preset pixel voltage conversion relationship according to the gray-scale threshold interval.

In an embodiment, the preset ratio threshold is 60%. When the ratio of the total amount of original pixel units in the gray-scale threshold interval to the total amount of all original pixel units in the sub-region is greater than 60%, the pixel voltage value of the original pixel units in the sub-region is adjusted. Specifically, during the adjustment of the pixel voltage value of the original pixel units in the sub-region, by reducing the original pixel voltage value in the sub-region, the large viewing angle brightness of the display panel is close to the positive viewing angle brightness. According to the new pixel voltage, the full gray-scale signal to the brightness change still maintains the exponential relationship with the original positive view signal to the brightness change. By reducing the pixel voltage of the original pixel units, the linearity of most pixel signals in the sub-region to the brightness change can be increased, and the color shift that is prone to large viewing angles can be reduced.

In this embodiment, the preset pixel voltage conversion relationship can be preset according to user needs. For example, the preset pixel voltage conversion relationship may be a relationship table of an average gray-scale value preset by the user, a corresponding threshold interval, and a corresponding pixel voltage value for maintaining the positive view signal.

In an embodiment, the gray-scale threshold interval includes a first gray-scale threshold and a second gray-scale threshold; specifically, the first gray-scale threshold is the average gray-scale value plus a first preset gray-scale value, and the second gray-scale threshold is the average gray-scale value minus a second preset gray-scale value.

In this embodiment, the corresponding first gray-scale threshold and second gray-scale threshold are set according to the average gray-scale value of each original pixel unit in each sub-region. The first gray-scale threshold is the average gray-scale value plus the first preset gray-scale value, and the second gray-scale threshold value is the average gray-scale value minus the second preset gray-scale value. Specifically, the first preset gray-scale value and the second preset gray-scale value can be set according to user needs.

Optionally, the first preset gray-scale value is equal to the second preset gray-scale value.

FIG. 9 is a schematic structural diagram of a display device according to an embodiment of the present application.

As shown in FIG. 9, the display device 60 in this embodiment includes a display panel 62; and a control circuit 61 which includes the driving device as described in any one of the above embodiments. The control circuit 61 is used to drive the display panel 62, wherein the control circuit 61 is electrically connected to the display panel 62.

In one embodiment, the control circuit is used to execute the driving method of the display panel 62 described in any one of the above embodiments.

In one embodiment, the driving method of the display panel 62 in this embodiment includes calculating an average gray-scale value of original pixel units in each sub-region of the display panel. Among then, the display panel is divided into n sub-regions, and n is an integer greater than 1.

In this embodiment, the display panel in the display device is divided into n sub-regions according to the effect that the panel needs to display. The n sub-regions can be formed according to the array arrangement, and the area of each sub-region is the same. For example, a display panel with a resolution of 1920×1080 is divided into 135 rows and 240 columns. Each sub-region includes 64-pixel units, and each pixel unit includes red pixel units, green pixel units, and blue pixel units. After the display panel is divided into multiple sub-regions, the average gray-scale value of the original pixel units in each sub-region is calculated, and the original pixel units are any one of the red pixel units, the green pixel units, and the blue pixel units.

In an embodiment, judging whether the average gray-scale value is greater than a preset gray-scale threshold includes if the average gray-scale value is greater than the preset gray-scale threshold, determining a corrected pixel voltage value of the sub-region according to the average gray-scale value and a preset pixel voltage conversion relationship.

Since the phenomenon of large view angle color shift is mainly caused by the pixel signal with high gray-scale value, when the average gray-scale value of the original pixel units of the sub-region is lower than the preset gray-scale threshold, the next step is not performed. That is, not to determine a corrected pixel voltage value of the sub-region according to the average gray-scale value and a preset pixel voltage conversion relationship, which saves calculation time and calculation steps. The preset gray-scale threshold is set by the user according to needs to judge whether the gray-scale value of the original pixel units is a high gray-scale pixel unit. For example, the preset gray-scale threshold in this embodiment can be set to 180. When the average gray-scale value of the original pixel units in the sub-region is lower than 180, then the next step is not to determine the corrected pixel voltage value of the sub-region according to the average gray-scale value and the preset pixel voltage conversion relationship. Specifically, each sub-region includes three original pixel units. The average gray-scale values of the three original pixel units are calculated, and then compared to the average gray-scale values of the three original pixel units with the preset gray-scale threshold respectively.

In this embodiment, the average gray-scale value of the original pixel units in each sub-region is obtained, and the average gray-scale value of the sub-region is judged. When the average gray-scale value is greater than the preset gray-scale threshold, the next step is to proceed. That is, the next step is to determine the corrected pixel voltage value of the sub-region according to the average gray-scale value and the preset pixel voltage conversion relationship. Specifically, the preset gray-scale threshold is set according to user needs and used to judge whether the average gray-scale value of the original pixel units of the sub-region is in the high gray-scale interval. If the average gray-scale value of the original pixel units is greater than the preset gray-scale threshold value set by the user, it is judged that the average gray-scale value of the original pixel units in the sub-region is in the high gray-scale interval. If the average gray-scale value of the original pixel units is less than or equal to the preset gray-scale threshold set by the user, it is judged that the average gray-scale value of the original pixel units in the sub-region is not in the high gray-scale interval. The preset pixel voltage conversion relationship includes setting pixel voltages corresponding to each of the average gray-scale values, acquiring the pixel voltage corresponding to the average gray-scale value from the preset pixel voltage conversion relationship, according to the average gray-scale value of the original pixel units in the sub-region, and when the average gray-scale value of the original pixel units in the sub-region is determined, determining the pixel voltage as the corrected pixel voltage value of the sub-region.

In an embodiment, the corrected pixel voltage value is set to the pixel voltage value of the original pixel units in the sub-region. In this embodiment, when the corrected pixel voltage value that matches the average gray-scale value of the corresponding sub-region is acquired, the corrected pixel voltage value is set to the pixel voltage value of the original pixel units in the sub-region. That is, by adjusting the pixel voltage value corresponding to the pixel voltage signal of the original pixel units in the sub-region, such that the full gray-scale signal in the sub-region still maintains the exponential relationship of the original positive view signal to the brightness change with respect to the brightness change.

In this embodiment, after the pixel voltage value of the original pixel units in the corresponding sub-region is modified to the corrected pixel voltage value, the difference of the high gray-scale pixel signal to the brightness change becomes smaller, the linearity is improved, and the color shift that easily occurs at the large view angle is reduced.

In an embodiment, the pixel voltage value of the original pixel units in the sub-region is the pixel voltage value of the total maximum pixel voltage signal in the sub-region.

In specific applications, the display panel can be any type of display panel, such as a liquid crystal display panel based on Thin Film Transistor Liquid Crystal Display (TFT-LCD) technology, and a liquid crystal display device (Liquid Crystal Display, LCD) based on Technology LCD panel, an organic electroluminesence (OLED) display panel based on OLED technology, a quantum dot light-emitting diodes (QLED) display panel based on OLED technology, or curved surface Display panel, etc.

In an embodiment, the control circuit 61 may be implemented by a general integrated circuit, such as a central processing unit (CPU), or by an application specific integrated circuit (ASIC).

In one embodiment, the display panel 62 includes a pixel array composed of multiple rows of pixels and multiple columns of pixels.

A person of ordinary skill in the art can understand that all or part of the processes in the above-mentioned embodiment methods can be implemented by instructing relevant hardware through a computer program. The program can be stored in a computer readable storage medium. During execution, it may include the procedures of the above-mentioned method embodiments. Among then, the storage medium may be a magnetic disk, an optical disc, a read-only memory (ROM), or a random access memory (RAM), etc.

In the driving method and the driving device of the display panel, and the display device provided by embodiments of the present application, by calculating the average gray-scale value of the original pixel units in each sub-region of the display panel, among then, the display panel is divided into n sub-regions, and n is an integer greater than 1, then judging whether the average gray-scale value is greater than a preset gray-scale threshold. If the average gray-scale value is greater than the preset gray-scale threshold, determining a corrected pixel voltage value of the sub-region according to the average gray-scale value and a preset pixel voltage conversion relationship, and setting the corrected pixel voltage value as a pixel voltage value of original pixel units in the sub-region. Thereby, the pixel voltage in the display panel is adjusted to reduce the color shift of the display panel, and the object of eliminating the image quality distortion of the display panel due to quick saturation when the brightness of the large viewing angle increases with the increase of the driving voltage, and improving user experience is achieved.

The aforementioned embodiments are only optional embodiments of the present application, and should not be regarded as being a limitation to the present application. Any modification, equivalent replacement, improvement, and so on, which are made within the spirit and the principle of the present application, should be included in the protection scope of the present application.

What is claimed is:

1. A driving method of a display panel, comprising:

calculating an average gray-scale value of original pixel units in each sub-region of the display panel;

judging whether the average gray-scale value is greater than a preset gray-scale threshold;

determining, if the average gray-scale value is greater than the preset gray-scale threshold, a corrected pixel voltage value of the sub-region according to the average gray-scale value and a preset pixel voltage conversion relationship by:

determining a gray-scale threshold interval corresponding to the sub-region according to the average gray-scale value; and determining a pixel voltage conversion value of the sub-region according to the gray-scale threshold interval and the preset pixel voltage conversion relationship; and setting the corrected pixel voltage value as a pixel voltage value of the original pixel units in the sub-region.

2. The driving method of claim 1, wherein calculating the average gray-scale value of the original pixel units in each sub-region of the display panel comprises:

acquiring a gray-scale value of each of the original pixel units in the sub-region; and generating the average gray-scale value according to a total number of the original pixel units and the gray-scale value of each of the original pixel units.

3. The driving method of claim 1, wherein determining the pixel voltage conversion value of the sub-region according to the gray-scale threshold interval and the preset pixel voltage conversion relationship further comprises:

judging whether a ratio of the original pixel units with gray-scale values in the gray-scale threshold interval in the sub-region is greater than a preset ratio threshold; and acquiring, if the ratio of the original pixel units with the gray-scale values in the gray-scale threshold interval in the sub-region is greater than the preset ratio threshold, a corrected pixel voltage value corresponding to the gray-scale threshold interval from the preset pixel voltage conversion relationship according to the gray-scale threshold interval.

4. The driving method of claim 3, wherein the preset ratio threshold is 60%.

5. The driving method of claim 1, wherein the gray-scale threshold interval comprises a first gray-scale threshold and a second gray-scale threshold, wherein the first gray-scale threshold is the average gray-scale value plus the first preset gray-scale value, and wherein the second gray-scale threshold is the average gray-scale value minus the second preset gray-scale value.

6. The driving method of claim 5, wherein the first preset gray-scale threshold is equal to the second preset gray-scale threshold.

7. The driving method of claim 1, wherein the preset pixel voltage conversion relationship comprises the gray-scale threshold interval and the corrected pixel voltage value corresponding to the gray-scale threshold interval preset by a user.

8. The driving method of claim 7, wherein the corrected pixel voltage value preset by the user has a linear relationship with the average gray-scale value of the original pixel units in the gray-scale threshold interval.

9. The driving method of claim 1, wherein the preset pixel voltage conversion relationship comprises a relationship table of an average gray-scale value preset by a user, a corresponding threshold interval, and a pixel voltage value that maintains the original front view signal.

10. A driving device of a display panel, comprising:

an average gray-scale calculation circuit configured for calculating an average gray-scale value of original pixel units in each sub-region of the display panel, wherein the display panel is divided into n sub-regions, and wherein n is an integer greater than 1;

an average gray-scale judgment circuit configured for judging whether the average gray-scale value is greater than a preset gray-scale threshold;

a pixel voltage acquisition circuit configured for determining a corrected pixel voltage value of the sub-region according to the average gray-scale value and a preset pixel voltage conversion relationship when the average gray-scale value is greater than the preset gray-scale threshold, wherein the pixel voltage acquisition circuit comprises:

a gray-scale threshold interval circuit configured for determining a gray-scale threshold interval corresponding to the sub-region according to the average gray-scale value; and a first pixel voltage acquisition circuit configured for determining a pixel voltage conversion value of the sub-region according to the gray-scale threshold interval and the preset pixel voltage conversion relationship; and a pixel voltage arrangement circuit configured for setting the corrected pixel voltage value as a pixel voltage value of the original pixel units in the sub-region.

11. The driving device of claim 10, wherein the average gray-scale calculation circuit comprises:

a gray-scale acquisition circuit configured for acquiring a gray-scale value of each of the original pixel units in the sub-region; and a gray-scale calculation circuit configured for generating the average gray-scale value according to a total number of the original pixel units and the gray-scale value of each of the original pixel units.

12. The driving device of claim 10, wherein the pixel voltage acquisition circuit further comprises:

a ratio judgment circuit configured for judging whether a ratio of the original pixel units with gray-scale values in the gray-scale threshold interval in the sub-region is greater than a preset ratio threshold; and a second pixel voltage acquisition circuit configured for acquiring a corrected pixel voltage value corresponding to the gray-scale threshold interval from the preset pixel voltage conversion relationship according to the gray-scale threshold interval when the ratio of the original pixel units with the gray-scale values in the gray-scale threshold interval in the sub-region is greater than the preset ratio threshold.

13. The driving device of claim 12, wherein the preset ratio threshold is 60%.

14. The driving device of claim 12, wherein the preset pixel voltage conversion relationship comprises the gray-scale threshold interval and the corrected pixel voltage value corresponding to the gray-scale threshold interval preset by a user.

15. The driving device of claim 14, wherein the corrected pixel voltage value preset by the user has a linear relationship with the average gray-scale value of the original pixel units in the gray-scale threshold interval.

16. The driving device of claim 10, wherein the gray-scale threshold interval comprises a first gray-scale threshold and a second gray-scale threshold, wherein the first gray-scale threshold is the average gray-scale value plus the first preset gray-scale value, and wherein the second gray-scale threshold is the average gray-scale value minus the second preset gray-scale value.

17. The driving device of claim 16, wherein the first preset gray-scale threshold is equal to the second preset gray-scale threshold.

18. A display device, comprising:

a display panel; and a control circuit electrically connected with the display panel, wherein the control circuit is configured for executing a driving method of the display panel, and wherein the driving method comprises:

calculating an average gray-scale value of original pixel units in each sub-region of the display panel;

judging whether the average gray-scale value is greater than a preset gray-scale threshold;

determining, if the average gray-scale value is greater than the preset gray-scale threshold, a corrected pixel voltage value of the sub-region according to the average gray-scale value and a preset pixel voltage conversion relationship by:

determining a gray-scale threshold interval corresponding to the sub-region according to the average gray-scale value; and determining a pixel voltage conversion value of the sub-region according to the gray-scale threshold interval and the preset pixel voltage conversion relationship; and setting the corrected pixel voltage value as a pixel voltage value of the original pixel units in the sub-region.

19. A driving method of a display panel, comprising:

calculating an average gray-scale value of original pixel units in each sub-region of the display panel;

determining whether the average gray-scale value is greater than a preset gray-scale threshold;

determining, when the average gray-scale value is greater than the preset gray-scale threshold, a corrected pixel voltage value of the sub-region according to the average gray-scale value and a preset pixel voltage conversion relationship, wherein the preset pixel voltage conversion relationship comprises a relationship table of an average gray-scale value preset by a user, a corresponding threshold interval, and a pixel voltage value that maintains the original front view signal; and setting the corrected pixel voltage value as a pixel voltage value of the original pixel units in the sub-region.

20. The driving method of a display panel of claim 19, wherein calculating the average gray-scale value of the original pixel units in each sub-region of the display panel comprises:

acquiring a gray-scale value of each of the original pixel units in the sub-region; and generating the average gray-scale value according to a total number of the original pixel units and the gray-scale value of each of the original pixel units.

* * * * *